US007938664B2

(12) United States Patent
Hsieh et al.

(10) Patent No.: US 7,938,664 B2
(45) Date of Patent: May 10, 2011

(54) CONNECTOR

(75) Inventors: Gary Hsieh, Taoyuan (TW); Nick Chin, Taoyuan (TW); Joseph Hsia, Taoyuan (TW); Steve Lev, Taoyuan (TW)

(73) Assignee: FCI, Versailles (FR)

( * ) Notice: Subject to any disclaimer, the term of this patent is extended or adjusted under 35 U.S.C. 154(b) by 0 days.

(21) Appl. No.: 12/223,228

(22) PCT Filed: Jan. 24, 2007

(86) PCT No.: PCT/SG2007/000022

§ 371 (c)(1),
(2), (4) Date: Jun. 7, 2010

(87) PCT Pub. No.: WO2007/086810

PCT Pub. Date: Aug. 2, 2007

(65) Prior Publication Data

US 2010/0240258 A1 Sep. 23, 2010

(30) Foreign Application Priority Data

Jan. 27, 2006 (TW) ..... 95103569 A

(51) Int. Cl.
*H01R 13/627* (2006.01)

(52) U.S. Cl. ..... 439/326; 439/327; 439/83

(58) Field of Classification Search ..... 439/326, 439/327, 83, 874, 876

See application file for complete search history.

(56) References Cited

U.S. PATENT DOCUMENTS

| | | | | |
|---|---|---|---|---|
| 6,095,827 | A * | 8/2000 | Dutkowsky et al. | 439/83 |
| 6,234,821 | B1 | 5/2001 | Tan | 439/328 |
| 6,464,514 | B1 | 10/2002 | Tsai et al. | 439/92 |
| 6,824,413 | B1 | 11/2004 | Shipe et al. | 439/326 |
| 7,175,461 | B1 * | 2/2007 | Ju | 439/326 |
| 7,661,973 | B2 * | 2/2010 | Lee et al. | 439/326 |
| 2004/0219813 | A1 | 11/2004 | Chang | 439/188 |

FOREIGN PATENT DOCUMENTS

| | | |
|---|---|---|
| CN | 2773928 Y | 4/2006 |
| EP | 0820124 A2 | 1/1998 |

* cited by examiner

*Primary Examiner* — Felix O Figueroa
(74) *Attorney, Agent, or Firm* — Harrington & Smith

(57) ABSTRACT

The present invention relates to a connector. The connector includes: a housing; a plurality of the terminals arranged thereon for electrically contacting with a board; a pair of arms extending from two ends of the housing, respectively; a first projection and a second projection formed on each of the arms; and a metal member arranged along the length direction of each of the arms, having a hold-down portion and a first recess for engaging with the first projection with a first buffer space existing therebetween. The metal member is spaced from the second projection by a second buffer space. When the hold-down portion is soldered to a board, the first projection or the second projection may remedy overwarp of the board or the housing.

4 Claims, 3 Drawing Sheets

CONNECTOR

FIELD OF THE INVENTION

The present invention relates to a connector, particular to a connector that is not easily distorted by high temperatures and external forces.

DESCRIPTION OF THE PRIOR ART

Current electronic products tend to be compact and light weight. Therefore, electrical devices used in manufacturing the electronic products tend to be miniaturized too.

Various electronic products use a connector to transmit signals. FIG. 1 shows a conventional connector. When the conventional connector is connected to an electronic product, it is unavoidable that the conventional connector experiences high temperature environments, such as a stove, or external forces, such as a force caused by inappropriate manual operation or mechanical errors in dimensions. The high temperature and external forces will result in distortion of some elements such as a plastic housing or a printed circuit board so that the connector cannot be accurately assembled.

SUMMARY OF THE INVENTION

To solve the above-identified problem, the present invention provides a connector that can be still accurately fixed to an electronic product such as a printed circuit board at a high temperature or with an external force. The connector according to an embodiment of the present invention comprises: a housing having two ends; a plurality of terminals arranged on the housing for electrically contacting with a board; a pair of arms extending from each of the ends of the housing; a first projection and a second projection formed on each of the pair of arms; and a metal member (112) including: a hold-down portion (114) and a first recess (116); wherein when the metal member (112) is detachably disposed along each of the arms (106), the first recess (116) is capable of accommodating the first projection (108) with a first buffer space (130) existing therebetween and the metal member (112) is spaced from the second projection (110) by a second buffer space (140), such that when the hold-down portion (114) is soldered to the board, the first projection (108) or the second projection (110) may prevent the board or the housing (102) from being overwarpped.

BRIEF DESCRIPTION OF THE DRAWINGS

The present invention can be understood with reference to the following figures.

DETAILED DESCRIPTION OF THE INVENTION

Figure 1:
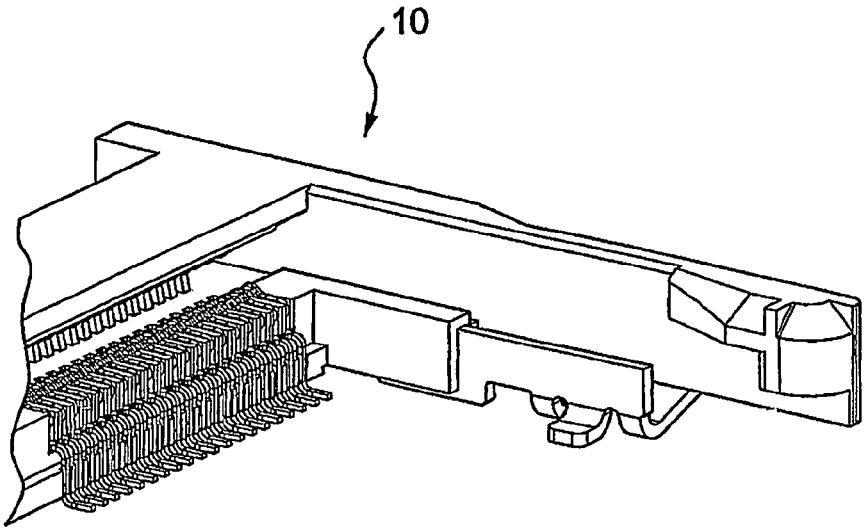
FIG. 1 (PRIOR ART)
FIG. 1 shows a conventional connector.
Figure 2:
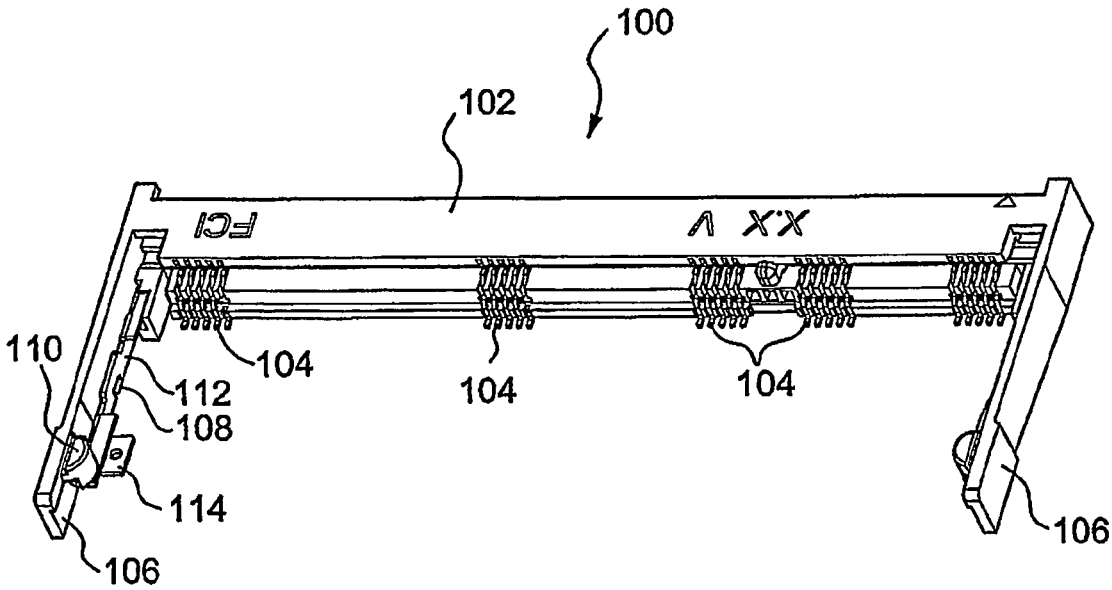
FIG. 2 is a schematic diagram of a connector according to an embodiment of the present invention.
Figure 3:
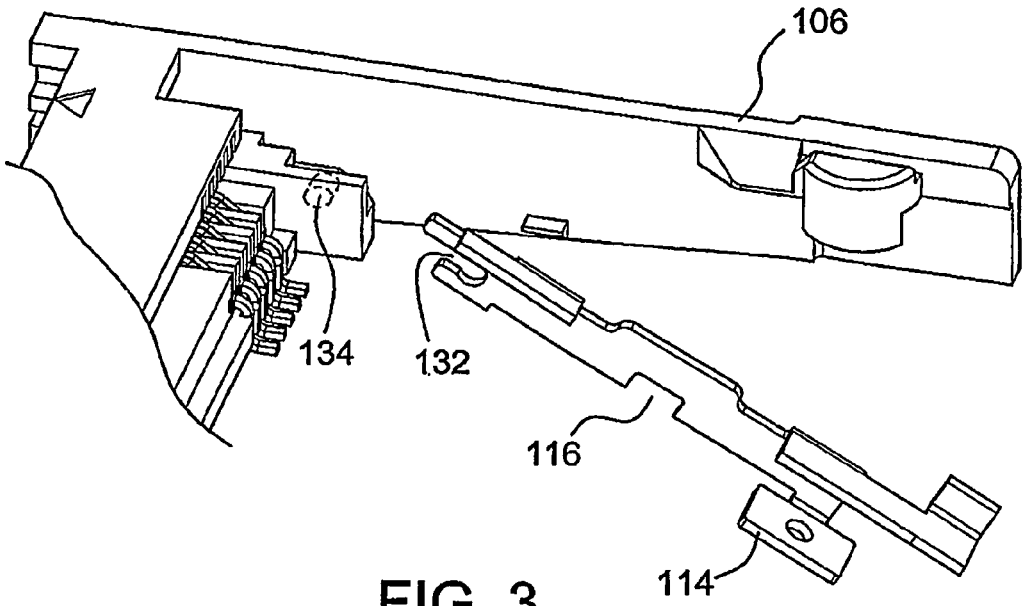
FIG. 3 is a schematic diagram of the connector of FIG. 2 that is disassembled.

FIG. 2 shows an embodiment of a connector of the present invention. The connector 100 comprises a housing 102 and a metal member 112. FIG. 3 is a schematic diagram of the connector of FIG. 2 that is disassembled. The housing 102 may comprise a pivot 134, and the metal member 112 may be detachably disclosed along each of the arms 106. With reference to FIG. 2 again, the housing 102 is provided with a plurality of conductive terminals 104 to be connected to an electronic product. In this embodiment, the electronic product may be a printed circuit board. The arms 106 are extended from two ends of the housing 102 and formed with a first projection 108 and second projection 110 respectively. In FIG. 3, the metal member 112 includes a hold-down portion 114 and a first recess 116. In this embodiment, the hold-down portion 114 is used to secure (for example, solder) the connector 100 to the printed circuit board (not shown).

Figure 4:
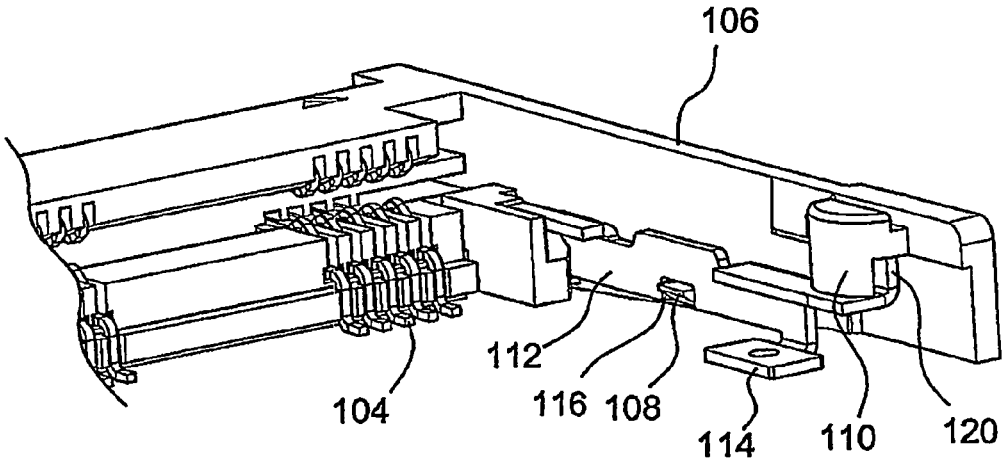
FIG. 4 is a partial schematic diagram of the connector of FIG. 2.
Figure 5A:
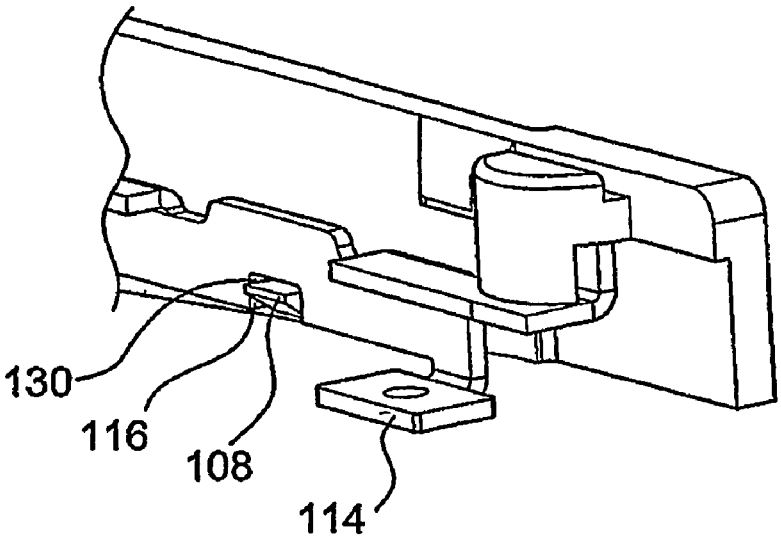
FIGS. 5A and 5B are enlarged schematic diagrams of a part of the connector of FIG. 4.
Figure 5B:
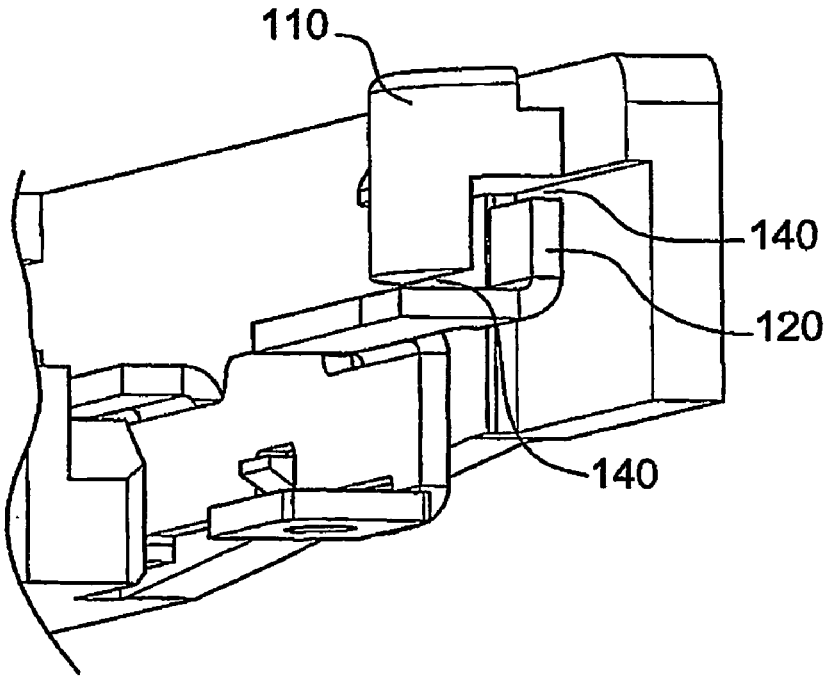

FIG. 4 is a partial schematic diagram of the connector of FIG. 2. The first projection 108 of the arm 106 is accommodated in the first recess 116 of the metal member 112. The mental member 112 may include a stopper portion 120 to prevent the arm 106 from being over-deflected. Please refer to FIGS. 5A and 5B, which are enlarged schematic diagrams of a part of the connector of FIG. 4. In this embodiment, the first recess 116 is capable of accommodating the first projection 108 with a first buffer space 130 existing therebetween and the metal member 112 is spaced from the second projection (110) by a second buffer space (140).

According to another embodiment, the first buffer space 130 is preferably 0.2 mm, and the second buffer space 140 is preferably 0.2 mm. However, in other embodiments, the first buffer space 130 and the second buffer space 140 are not limited to 0.2 mm and can be adjusted according to structural features of the connector. During the elements of the connector are assembled, the hold-down portion (114) of the mental member 112 is soldered to the printed circuit board. During the soldering step, the printed circuit board and/or the housing maybe distorted or warped due to the heat or the external force. The first buffer space 130 and the second buffer space 140 may accommodate the distortion or warpage of the printed circuit board or the housing 102, and the connector 100 may still be accurately fixed to the printed circuit board.

It should be understood that the embodiments as described above only are preferred embodiments of the present invention. Modifications made according to the spirit of the present invention and their functions do not depart from the spirit of the present invention covered by the specification and the drawings and should be included within the scope of the claims.

What is claimed is:

1. A connector comprising:

a housing having two ends;

a plurality of terminals arranged on the housing for electrically contacting with a board;

a pair of arms extending from each of the ends of the housing;

a first projection and a second projection formed on each of the pair of arms; and a metal member including: a hold-down portion and a first recess; wherein when the metal member is detachably disposed along each of the arms, the first recess is capable of accommodating the first projection with a first buffer space existing therebetween and the metal member is spaced from the second projection by a second buffer space, such that when the hold-down portion is soldered to the board, the first projection or the second projection may prevent the board or the housing from being overwarpped, wherein the housing further includes a pivot portion and the metal member further includes a second recess for engaging with the pivot portion.

2. The connector according to claim 1, wherein the metal member further includes a stopper portion for preventing the arm from being over-deflected.

3. The connector according to claim 1, wherein the first buffer space is 0.2 mm.

4. The connector according to claim 1, wherein the second buffer space is 0.2 mm.

* * * * *